United States Patent [19]

Binns

[11] 4,014,572

[45] Mar. 29, 1977

[54] LATCHING APPARATUS FOR A TRUCK DOOR

[76] Inventor: John W. Binns, 1010 Champagne Drive, Marion, Ohio 43302

[22] Filed: Dec. 1, 1972

[21] Appl. No.: 311,310

[52] U.S. Cl. ..... 292/108; 292/134; 292/DIG. 32

[51] Int. Cl.[2] ..... E05C 19/10

[58] Field of Search ..... 292/108, 100, 104, 113, 292/126, 134, 136, 210, 241, DIG. 32, 341.13, 240

[56] References Cited

UNITED STATES PATENTS

| | | | |
|---|---|---|---|
| 1,495,373 | 5/1924 | Witten | 292/108 |
| 1,495,374 | 5/1924 | Witten | 292/136 |
| 3,347,580 | 10/1967 | Whiting | 292/128 |
| 3,560,038 | 2/1971 | Gunther | 292/141 |
| 3,642,314 | 2/1972 | Smith | 292/134 |
| 3,740,978 | 6/1973 | Smith | 70/100 |

*Primary Examiner*—Robert L. Wolfe
*Attorney, Agent, or Firm*—Biebel, French & Nauman

[57] ABSTRACT

There is disclosed a self-adjusting latch for an overhead truck door comprising a latch bolt, a keeper, and a bolt catch all pivotally mounted at predetermined locations on a common support plate. The latch bolt has an integral actuating arm and an integral hook for latching engagement with a catch pin mounted in the bed of the truck. The weight of the latch bolt is distributed in such a manner that after latching, the latch bolt is continuously urged against the catch pin. Thus the latch is continuously self-adjusting during normal operation of the truck over rough or uneven terrain. The keeper is rotatable from a locked to an unlocked position, and when it is in the locked position it prevents unlatching of the latch bolt by abutting engagement thereagainst. When the truck is in transit, the keeper is maintained in the locked position by locking a finger thereon against a lug struck out from the support plate. When the truck is to be unloaded, the keeper is unlocked from the lug and rotated to the unlocked position whereby the latch bolt may be rotatably disengaged from the catch pin by operation of the actuating arm. With the latch bolt in the fully unlatched position, the bolt catch releasably engages a projection on the latch bolt to maintain the actuating arm in a fixed horizontal position. In this position the actuating arm may be grasped to lift the truck door. There is also disclosed a catch box for readily mounting the catch pin in the bed of the truck in correct position for cooperation with the latch bolt.

1 Claim, 6 Drawing Figures

LATCHING APPARATUS FOR A TRUCK DOOR

BACKGROUND OF THE INVENTION

This invention relates to latching apparatus for an upwardly acting truck door, and more particularly to overhead truck doors which may be of either sectional or single piece construction. Further the invention relates to such doors as applied to truck trailers or to trailer bodies which have been separated from the trailer chassis for independent use or transport, and it is to be understood that the word "truck" is used broadly herein to include such trailers and trailer bodies. In any event in the application of such doors to normal trucking operations it is necessary to provide means for latching the door closed after truck loading, and thereafter to lock and seal the latch. This prevents pilferage and provides evidence of unauthorized opening by the truck driver.

A number of specialized latching devices are available for such purposes, but they are generally expensive, complicated in their operation, and difficult to install. Typical examples of prior art latching devices are shown for instance in Whiting U.S. Pat. No. 3,347,580, Smith U.S. Pat. No. 3,514,142, and Rosehitz U.S. Pat. No. 3,622,189. It will be appreciated that during normal bumping operation of a truck, the latch is disposed to rattle with attendant noise and wear. Accordingly it is desirable to provide for self-adjusting operation as shown for instance in Rosehitz or in Smith et al U.S. Pat. No. 3,510,162. In each of these cases self-adjusting operation of the lock is provided by springs which continuously urge the latch bolt against a catch pin mounted in the bed of the truck. As an alternate to the above-mentioned spring, there may be provided self-actuation by gravity operation as shown for instance in Smith et al U.S. Pat. No. 3,642,314.

While the above-mentioned self-actuating latching devices have provided improved operation over other earlier devices, there has still existed a need for providing latching of an upwardly acting truck door in a simpler and more economical way.

SUMMARY OF THE INVENTION

In accordance with the present invention there is provided a simple latching arrangement which may be easily mounted as a unit on a single support plate for attachment to an upwardly acting truck door. The principal elements in the arrangement are a pivotally mounted, single piece latch bolt and a keeper mounted for abuttingly preventing unlatching rotation of the latch bolt. Means are provided for locking the keeper in position, thereby maintaining the latch bolt in a latched condition while permitting adjusting movement. The keeper is preferably mounted pivotally and provided with a locking finger for locking engagement with a lug attached to or struck out from the support plate. The latch bolt has an integral hook for engagement against a catch pin mounted in the bed of the truck, and an integral actuating arm for effecting unlatching rotation of the latch bolt. A bolt catch is provided for engaging the latch bolt in the fully unlatched position whereby the actuating arm may be upwardly pulled for raising the truck door. The latch bolt is preferably configured with its center of gravity displaced horizontally from the latch bolt pivot point for gravity controlled adjustment of the latch bolt hook against the catch pin. Further in accordance with the practice with this invention there may be provided a catch box for mounting the catch pin in the bed of the truck in proper alignment with the bolt support plate.

Accordingly it is a principal object of this invention to provide improved latching for an upwardly acting truck door or the like by means of a pivotally mounted single piece latch bolt.

Other objects and advantages of the invention will be apparent from the following description, the accompanying drawings and the appended claims.

DESCRIPTION OF THE PREFERRED EMBODIMENTS

Figure 1:
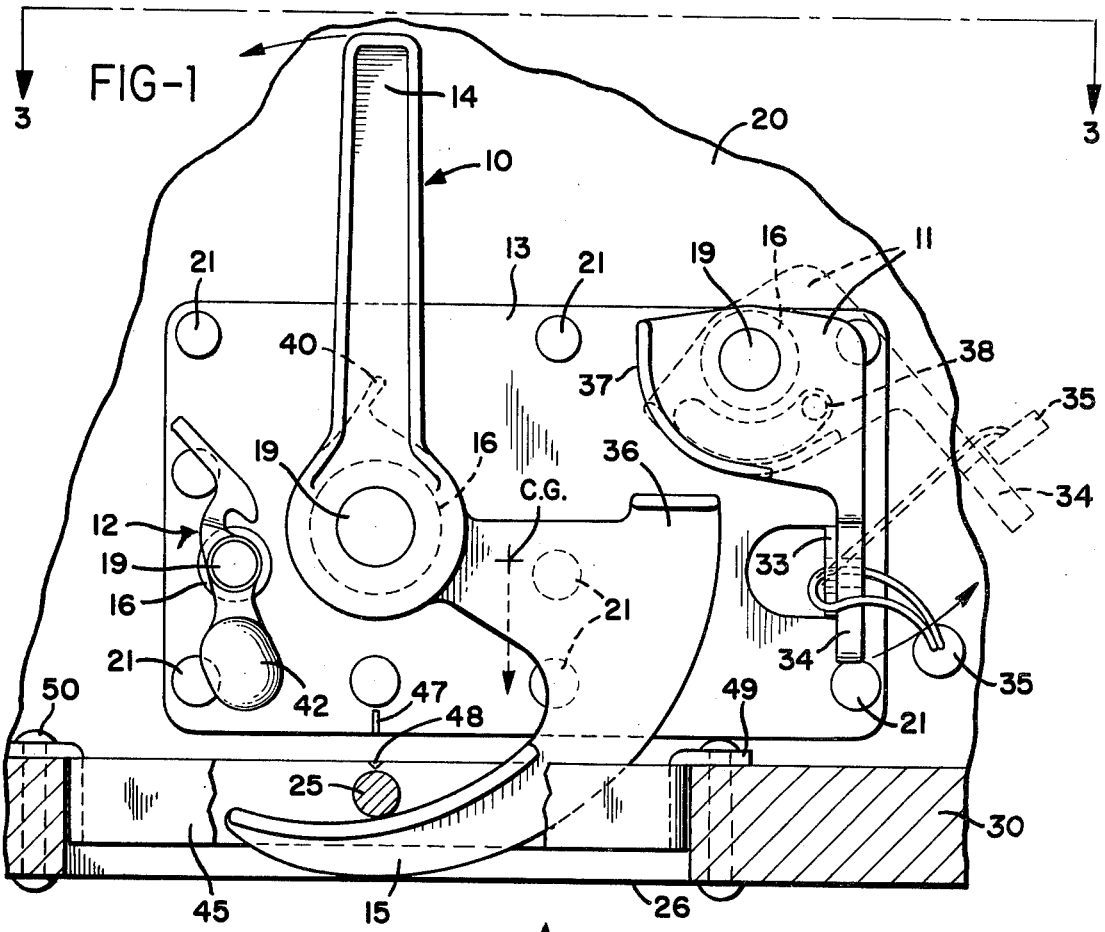
FIG. 1 is a fragmentary rear elevation view of a truck showing the latching apparatus of the present invention in a fully latched condition.

The preferred embodiment of this invention is illustrated in the rear elevation view of FIG. 1 wherein a latch bolt 10 is pivotally mounted on truck door 20 for latching engagement against a catch pin 25 mounted in truck bed 30. There are also a keeper 11 and a bolt catch 12 pivotally mounted on truck door 20. Preferably latch bolt 10, keeper 11 and bolt catch 12 are all mounted on a common support plate 13 which may be fastened to truck door 20 as by rivets 21. By employing this arrangement it is possible to prealign latch bolt 10, keeper 11, and bolt catch 12 and mount them as a unit on a truck door. This is in contrast to the usual prior art approach wherein it is necessary to carry out a tedious alignment and mounting procedure on the door itself.

Latch bolt 10 comprises an integral actuating arm 14 and an integral hook 15. The configuration of latch bolt 10 is such that in the latched condition as shown in FIG. 1, the center of gravity of the latch bolt is horizontally displaced from the latch bolt pivot point. Thus the latch bolt tends to rotate clockwise as viewed in FIG. 1 forcing hook 15 continually against catch pin 25. This prevents rattling of the catch bolt during operation of the truck.

Figure 3:
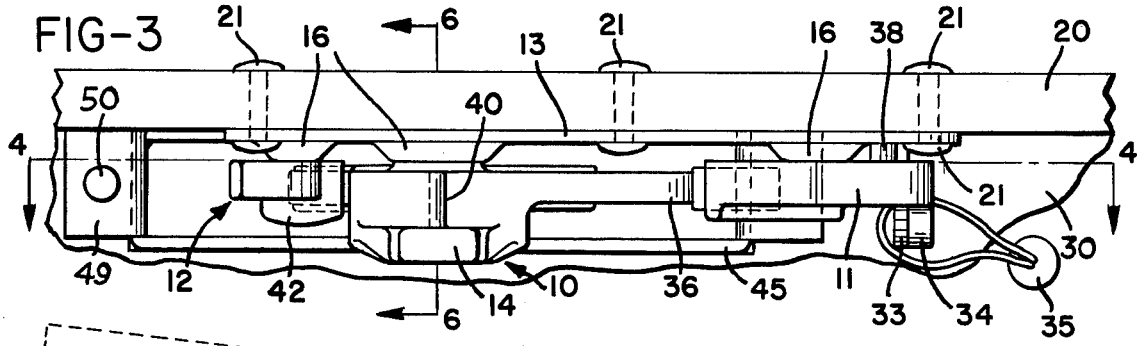
FIG. 3 is a view taken along lines 3—3 of FIG. 1.
Figure 6:
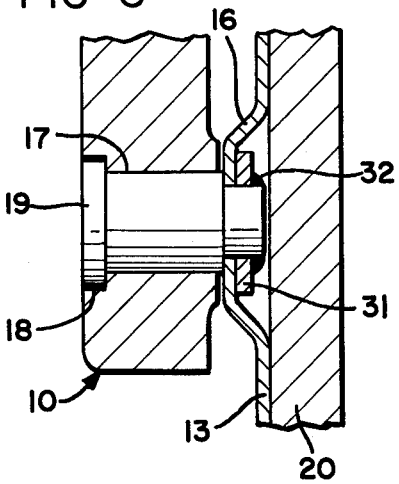
FIG. 6 is a view taken along lines 6—6 of FIG. 3.

As shown in FIG. 3, latch bolt 10, keeper 11 and bolt catch 12 are mounted on raised portions 16 of mounting plate 13. Latch bolt 10, keeper 11 and bolt catch 12 are all similarly mounted by means as shown in FIG. 6 for the latch bolt. Thus there is a mounting aperture 17 in latch bolt 10 with a recess 18 at the outer extension thereof. A pin 19 fits into aperture 17 and thence through a mating aperture of reduced diameter in raised portion 16 of mounting plate 13. The head of pin 19 sits in recess 18 so that it may not be reached by a hacksaw or other cutting tool. A washer 31 is placed around the protruding end of pin 19 and welded onto pin 19 by a weld 32. The entire assembly is flush for mounting on truck door 20.

Figure 4:
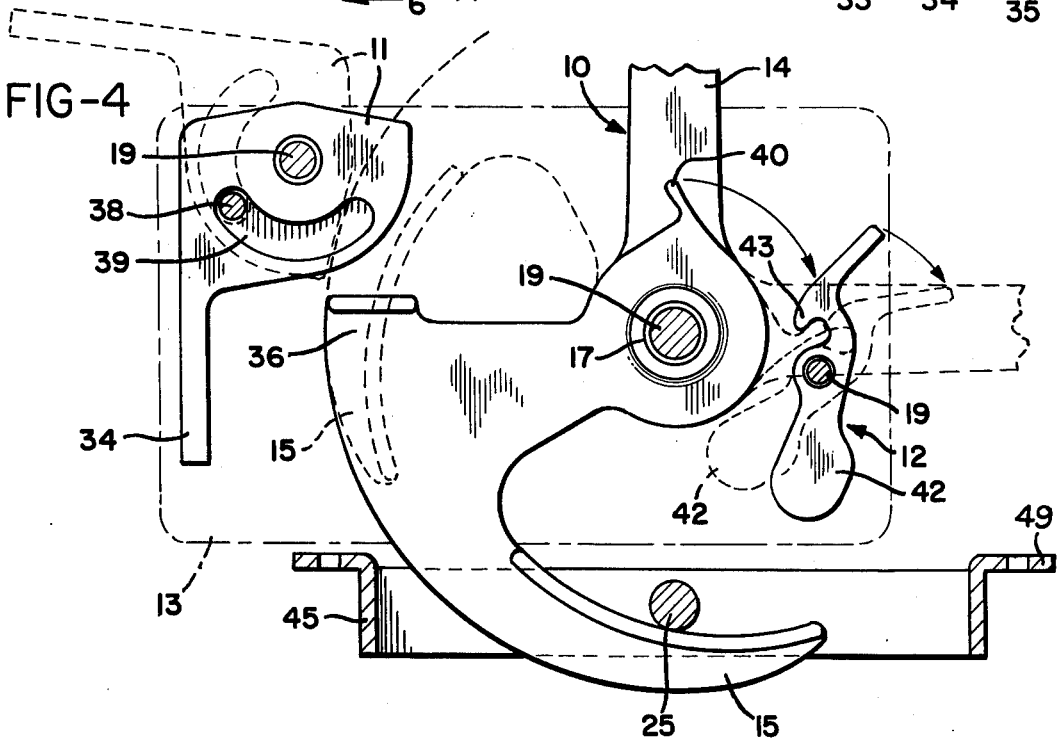
FIG. 4 is a view taken along lines 4—4 of FIG. 3 and illustrates the unlatching motion of the apparatus of this invention.

There is a locking lug 33 which may be struck out from plate 13 for locking engagement with a finger 34 of keeper 11. For this purpose mating apertures may be provided in lug 33 and finger 34 and a seal 35 placed therethrough. Normally seal 35 will be used together with a lock, but depending upon the circumstances either or both of the seal or lock may be omitted. Keeper 11 is so weighted that finger 34 normally swings against lug 33 even in the absence of a seal or lock. Latch bolt 10 has an enlarged abutment area 36 which faces an enlarged arc-shaped surface 37 of keeper 11. When keeper 11 is locked into position as shown in FIG. 1, unlatching rotation of latch bolt 10 is prevented by abutting engagement of area 36 against surface 37. Surface 37 follows an arc of about 90° extent so that keeper 11 may be rotated all the way to the position shown in FIG. 2 before permitting unlatching rotation of latch bolt 10. The rotated position of keeper 11 as shown by phantom lines in FIG. 1 represents the maximum usual rotation of the keeper without visible damage to seal 35. When seal 35 is removed and keeper 11 is rotated further to the position shown in FIG. 2, then latch bolt 10 may be rotated to the fully unlatched position. FIG. 4 illustrates the clearance between latch bolt 10 and keeper 11 during the unlocking and unlatching sequence. Unlocking rotation of keeper 11 is limited as shown in FIG. 4 by a pin 38 which fits into an arc-shaped channel 39 on the inner surface of keeper 11. Pin 38 is welded directly to mounting plate 13.

Figure 2:
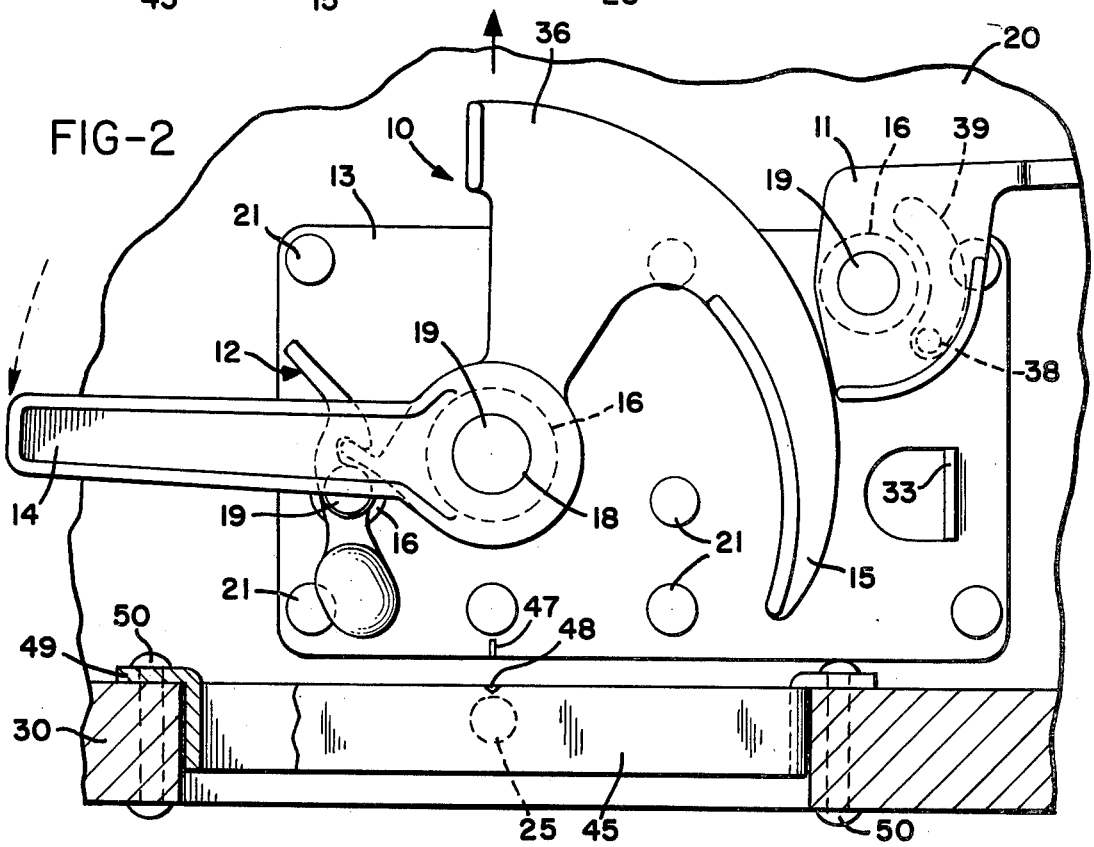
FIG. 2 illustrates the apparatus of FIG. 1 in a fully unlatched condition.
Figure 5:
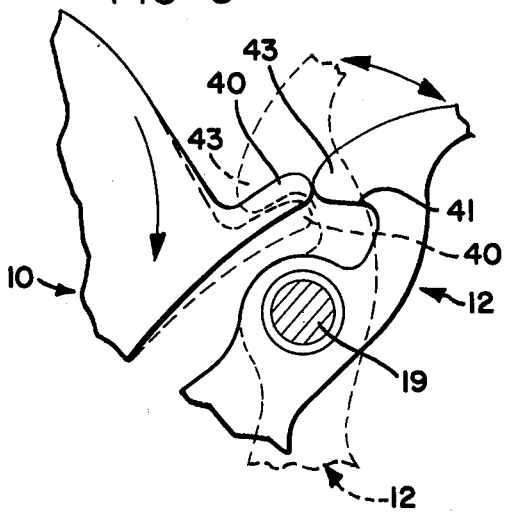
FIG. 5 is a fragmentary view illustrating the catching operation of the bolt catch of this invention.

There is a projection 40 on latch bolt 10 which engages a recess 41 in bolt catch 12 when latch bolt 10 is in the fully unlatched position as shown in FIG. 2. In this position with bolt catch 12 engaged as shown in FIG. 2, actuating arm 14 may be grasped and pulled upwardly for opening the truck door. Bolt catch 12 is provided with a weighted area 42 for facilitating a catching motion as shown in FIG. 5. Thus as latch bolt 10 is rotated toward the fully unlatched position, projection 40 on latch bolt 10 contacts a projection 43 on bolt catch 12 to rotate bolt catch 12 to the position shown in FIG. 4. Thereafter latch bolt 10 comes to rest against bolt catch 12 and the weighted portion 42 causes bolt catch 12 to swing into position for catching projection 40 and preventing reverse rotation of latch bolt 10. Thus actuating arm 14 may serve as a handle for raising and thereafter lowering truck door 20. Disengagement of latch bolt 10 from bolt catch 12 is easily effected by manual rotation of bolt catch 12.

It will be appreciated that the operation of hook 15 requires proper clearance on both sides of catch pin 25. This clearance may be afforded by mounting catch pin 25 in a catch box 45. Normally the latching apparatus is sold as part of a complete truck door, but it may be mounted as a unit on a previously installed door. In either event there will be an index mark 47 on plate 13 for alignment with a similar index mark 48 on catch box 45. For installation purposes catch box 45 may be placed on the truck bed threshold with truck door 20 in a closed or nearly closed position and with index mark 48 in alignment with index mark 47. Then a line may be traced on the truck bed around catch box 45, and a cut may be made around this line to create the truck bed opening 26. Thereafter catch box 45 is lowered into opening 26 and secured in place. In the case of a steel truck bed catch box 45 may be flush welded in place. For trucks with wood beds catch box 45 may be provided with a projecting ledge 49 for riveting in place as by rivets 50.

While the form of apparatus herein described constitutes a preferred embodiment of the invention, it is to be understood that the invention is not limited to this precise form of apparatus, and that changes may be made therein without departing from the scope of the invention.

What is claimed is:

1. In a truck comprising an upwardly acting overhead door, a latch mounted on a support plate at the base of said door, and a catch pin mounted in the bed of said truck for engagement with said latch, the improvement wherein said latch comprises:

a latch bolt comprising an integral actuating arm and an integral hook and being pivotally mounted on said door whereby the weight of said latch bolt urges said hook self-adjustingly against said catch pin when said hook is in engaging relation therewith, a keeper mounted on said support plate in position for abuttingly preventing disengagement of said hook from said catch pin, said keeper being pivotally movable from said position to another position whereby said disengagement is permitted, the rotation of said keeper from said position to said another position being limited by a stop peg mounted on said support plate and engageable with an arc shaped channel on the inner surface of the keeper, and means for locking said keeper in said disengagement preventing position.

* * * * *